US006874914B2

(12) United States Patent
Desanto et al.

(10) Patent No.: US 6,874,914 B2
(45) Date of Patent: Apr. 5, 2005

(54) ADJUSTABLE LIGHTING SYSTEM

(75) Inventors: Albert L. Desanto, Rolling Hills Estates, CA (US); Jerry L. Wilson, Sun City, CA (US)

(73) Assignee: Sage Technology, LLC, Escondido, CA (US)

( * ) Notice: Subject to any disclaimer, the term of this patent is extended or adjusted under 35 U.S.C. 154(b) by 0 days.

(21) Appl. No.: 10/310,662

(22) Filed: Dec. 4, 2002

(65) Prior Publication Data

US 2004/0109322 A1 Jun. 10, 2004

(51) Int. Cl.[7] ..... F21V 19/02

(52) U.S. Cl. ..... 362/372; 362/256; 362/277; 362/319; 362/328; 362/345; 362/348; 362/350; 362/373; 362/413; 362/430; 362/433; 362/449

(58) Field of Search ..... 362/449, 372, 362/255, 256, 277, 319, 327, 328, 345, 348, 350, 373, 413, 430, 433

(56) References Cited

U.S. PATENT DOCUMENTS

| | | | | |
|---|---|---|---|---|
| 1,286,535 A | | 12/1918 | Cochron | |
| 4,173,037 A | | 10/1979 | Henderson, Jr. et al. | |
| 4,231,080 A | | 10/1980 | Compton | |
| 4,363,086 A | | 12/1982 | Fletcher | |
| 4,403,277 A | | 9/1983 | Eargle, Jr. et al. | |
| 4,507,717 A | * | 3/1985 | Wijbenga | 362/304 |
| 4,780,799 A | * | 10/1988 | Groh | 362/294 |
| 4,943,901 A | | 7/1990 | Baldwin et al. | |
| 5,073,845 A | | 12/1991 | Aubrey | |
| 5,077,648 A | * | 12/1991 | Rosz | 362/509 |
| 5,178,452 A | | 1/1993 | Scholz | |
| 5,251,116 A | | 10/1993 | Wijbenga et al. | |
| 5,398,178 A | | 3/1995 | Roth | |
| 5,404,297 A | * | 4/1995 | Birk et al. | 362/421 |
| 5,434,765 A | * | 7/1995 | Kelly et al. | 362/271 |
| 5,452,192 A | | 9/1995 | Yurich | |
| 5,582,479 A | | 12/1996 | Thomas et al. | |
| 5,791,768 A | | 8/1998 | Splane, Jr. et al. | |
| 5,803,593 A | | 9/1998 | Siminovitch et al. | |
| 5,808,450 A | * | 9/1998 | Chula et al. | 322/22 |
| 5,863,677 A | | 1/1999 | Connors et al. | |
| 6,033,093 A | | 3/2000 | Latsis et al. | |
| 6,053,623 A | | 4/2000 | Jones et al. | |
| 6,053,625 A | * | 4/2000 | Bowker | 362/348 |
| 6,068,388 A | | 5/2000 | Walker et al. | |
| 6,132,067 A | | 10/2000 | Scholz | |
| 6,152,579 A | | 11/2000 | Reed et al. | |
| 6,273,590 B1 | | 8/2001 | Splane, Jr. et al. | |
| 6,338,564 B1 | | 1/2002 | Jordan et al. | |

FOREIGN PATENT DOCUMENTS

| | | | | |
|---|---|---|---|---|
| GB | 2141346 A | * | 7/1985 | F21V/1/10 |

* cited by examiner

*Primary Examiner*—Stephen Husar
*Assistant Examiner*—Sharon Payne
(74) *Attorney, Agent, or Firm*—Fitch, Even, Tabin & Flannery

(57) ABSTRACT

An adjustable lighting system which is particularly applicable for efficiently and effectively lighting areas of limited ceiling height such as parking garages and the like. A lamp base is supported within a housing in a manner so that it may be vertically adjustable with respect to a lower reflector carried by the housing. An upper reflector, which is vertically adjustable with respect to both the lamp base and the housing, is selected to provide a desired pattern of lighting for a particular installation. Although the lighting system may be employed with a plurality of different lamps, use of an induction lamp is preferred, and when an induction lamp is used, the combination of it with a novel, upper reflector of combined curvature having a central frustoconical downward section, is particular advantageous and provides excellent uniform distribution of illumination.

8 Claims, 4 Drawing Sheets

ADJUSTABLE LIGHTING SYSTEM

This application relates to adjustable lighting systems, and more specifically, to lighting systems that are economical to operate and that will efficiently light broad areas, particularly broad areas where ceilings are of limited height, for example, in parking garages and the like.

BACKGROUND OF THE INVENTION

Because of the widely varying needs of areas having lighting requirements, it has been found necessary to incorporate adjustability into "standard" lighting systems.

Henderson Jr., et al U.S. Pat. No. 4,173,037 discloses a luminaire lamp support device in which the lamp socket is adjustably mounted on a bracket for adjustment of the socket along a substantially vertical axis. This enables adjustment of the lamp to different positions to obtain various light distribution patterns. The lamp has an outer reflector and an asymmetric inner reflector which is mounted for rotational adjustment about the vertical axis of the luminaire for producing asymmetric distribution of reflected light.

Sholtz U.S. Pat. No. 5,178,452 discloses a lamp designed for surgical operations with an outer reflector which illuminates the area of operation and an auxiliary reflector having an outer diameter which corresponds approximately to the inner diameter of the outer reflector and which is arranged inside the outer reflector to deflect a part of the light beam at a steeper or narrow angle into a surgical wound.

Wijbenga, et al U.S. Pat. No. 5,251,116 discloses a luminaire for creating a primary beam and a secondary beam. Baldwin, et al U.S. Pat. No. 4,943,901 discloses a luminaire with auxiliary reflecting means for reflecting light passing through the top opening and for reflecting such light to illuminate stacked material along the edges of the aisle. Compton U.S. Pat. No. 4,231,080 discloses a luminaire having at least three stack reflector members. Cochran U.S. Pat. No. 1,286,535 discloses a lighting fixture having a outer reflector and a stationary auxiliary reflector.

U.S. Pat. No. 5,582,479 to Thomas et al. discloses a dual reflector high bay lighting system which is designed for operation with a gaseous discharge or high intensity discharge (HID) lamp and employs an outer reflector, that is attached to an upper casing by an adjustable bracket, and an inner reflector that is coaxial with the lamp and is axially adjustable with respect to the lamp base. It is particularly useful in being able to effectively light aisles between storage racks or other arrangements of stacked merchandise which may border such aisles, as illustrated in FIG. 5B.

U.S. Pat. No. 5,791,768 to Splane also discloses a luminaire which utilizes a high intensity or gaseous discharge lamp. It employs coaxially mounted outer and inner reflectors where the inner reflector is adjustable coaxially along the longitudinal axis of the lamp, so as to direct a substantial amount of light onto a first area, while a smaller amount of light is reflected from the outer reflector onto a wider area bordering the first area.

Whereas certain of the lighting devices illustrated and described in the foregoing patents are particularly advantageous for the specific lighting applications, none of them are felt to have addressed the problems of efficiently and economically lighting regions where there is a limited ceiling height as in the parking garages, industrial corridors, washrooms, low overhead storage areas, transit rail or bus stational platforms, maintenance areas or the like. Accordingly, the search has continued for such lighting systems.

SUMMARY OF THE INVENTION

In one aspect, the invention provides a lighting system particularly adapted to operate with highly efficient induction lamps which produce a bright white light, which are economical to operate and which have extended lifetimes of over 10 years. In a more particular aspect, the invention provides an adjustable lighting system comprising a housing having a sidewall and an open bottom, a lamp base for holding a induction lamp in depending relationship thereto, a metallic heat sink support affixed to said housing and to said lamp base to support an induction lamp on about a centerline of said housing, an upper reflector having a central opening to accommodate the neck of a lamp, means mounting said upper reflector in depending relationship from said housing or from said heat sink so as to be adjustable in a direction axial to a lamp held by said base, an HF generator mounted within said housing and electrically connected to said lamp base, and a lower reflector or refractor proportioned to surround said upper reflector and a lamp held by said base, which lower reflector is supported from said housing and extends below said lamp and said upper reflector.

In another aspect, the invention provides an adjustable lighting system comprising a housing having a sidewall and an open bottom, a lamp base for holding a lamp in depending relationship thereto, a support affixed to said housing and to said lamp base to support said lamp on about a centerline of said housing, a reflector having a central opening to accommodate the neck of a lamp, and means mounting said reflector in depending relationship from said housing or from said support so as to be adjustable in a direction axial to a lamp held by said base; the reflector has a downwardly frustoconical center section and a contiguous annular, generally flat outer section.

In a further aspect, the invention provides a lighting system that is particularly adaptable to the use of lamps of variety of sizes, which system is, by appropriate selection of an upper adjustable reflector from among a variety of different shapes that are offered, able to efficiently and effectively light areas of limited ceiling height as a result of the ability to adjust the position of a lamp with respect to both an upper and a lower reflector. In a yet further, more particular aspect, the invention provides an adjustable lighting system comprising a housing having a generally cylindrical outer sidewall and an open bottom, a lamp base, support means connected to said housing and to said lamp base to position said lamp base on about the centerline of said generally cylindrical housing, an upper reflector having a central opening to accommodate the neck of a lamp, means mounting said upper reflector in depending relationship from said lamp base so as to be adjustable in a direction axial to a lamp connected to said base, and a generally frustoconical lower reflector which surrounds a lamp connected to said base and which extends below said upper reflector, which lower reflector is supported from said housing. The support means is adjustable in an axial direction to permit varying the positioning of said lamp base relative to the housing and to the lower reflector while said upper reflector is adjustable with respect to said lamp base, and the open bottom of the housing is preferably closed by a suitable lens that may be clear or prismatic.

DETAILED DESCRIPTION OF THE PREFERRED EMBODIMENTS

The following description describes and explains the best presently contemplated modes for carrying out the inventions. However, the description is made for the purpose of illustrating the general principles of an invention, and it is not intended to limit the scope of the invention, which is defined in the claims appended hereto.

Figure 1:
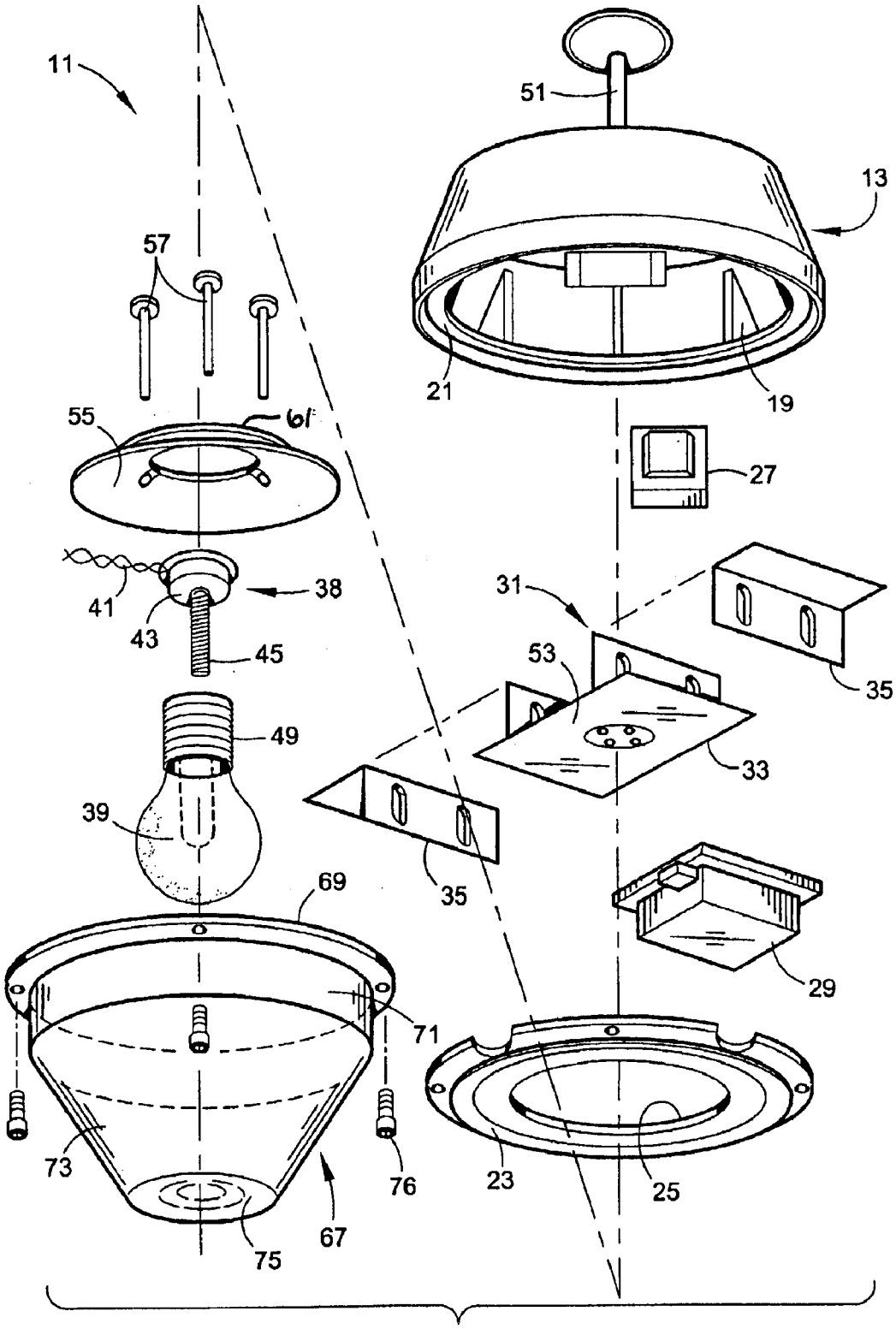
FIG. 1 is an exploded perspective view of a lighting system embodying various features of the invention.
Figure 2:
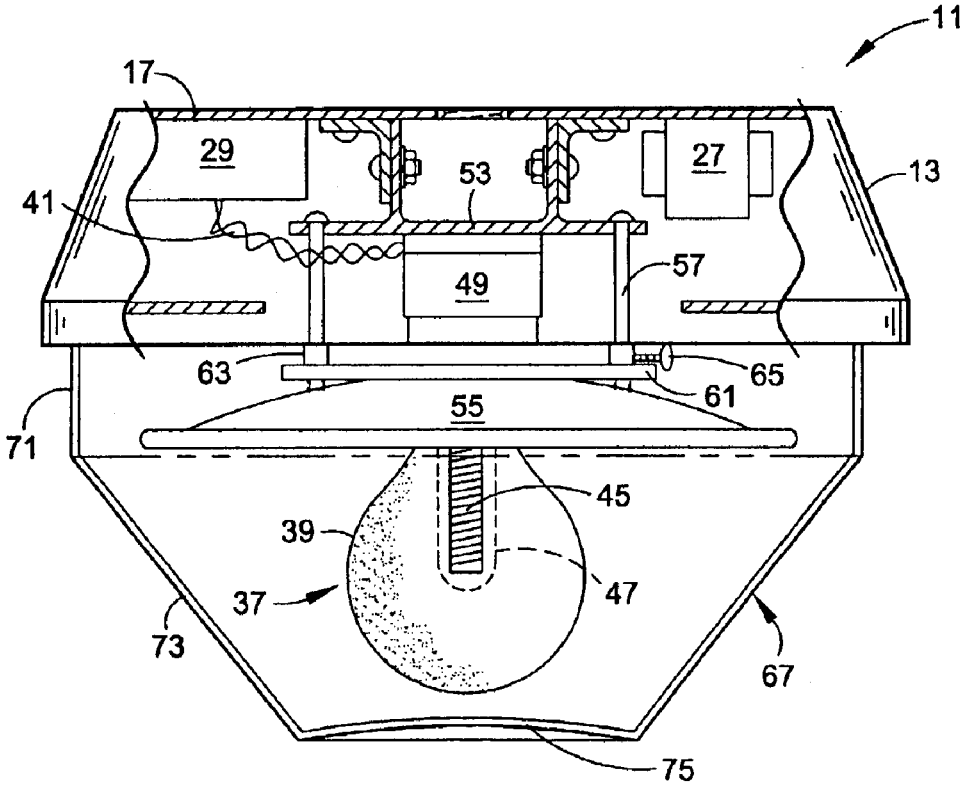
FIG. 2 is a front view of the lighting system shown in FIG. 1 without the pendant support and with the housing broken away to show the interior assembly.
Figure 3:
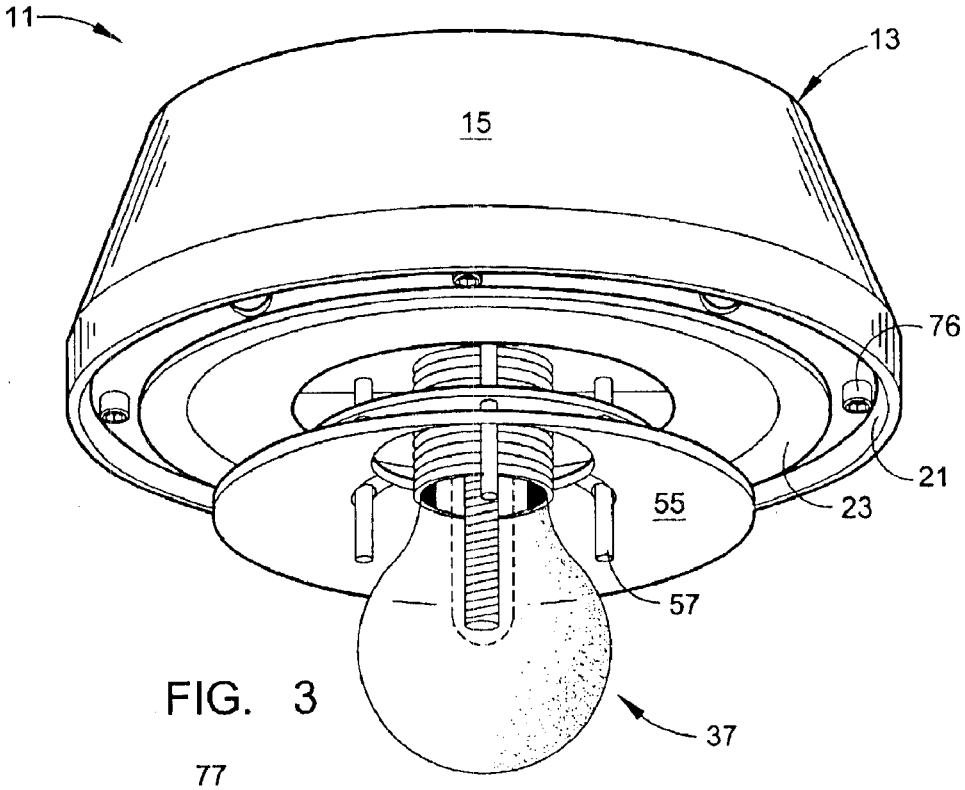
FIG. 3 is a perspective view of the lighting system of FIG. 2 shown with the lower refractor omitted.

FIGS. 1 through 3 show a lighting system or luminaire 11 having a housing or casing 13 which contains the electrical operating components, other than a lamp itself, for operating an electrical lamp. The housing 13 includes a sidewall 15, which is referred to as being generally cylindrical, and a flat upper wall 17; it is open at its bottom. As used in this description, the term generally cylindrical should be understood to include a frustoconical sidewall where the angle of taper is not greater than about 30°. When a frustoconical shape is used, as in FIGS. 1 and 2, the interior of the sidewall may be provided with integral support in a form of a plurality of radially extending gussets 19. The bottom end of the sidewall is formed with a rim 21 that includes an inwardly extending short flange in which drilled and/or tapped holes can be provided to accept threaded connectors as described hereinafter. Once all of the electrical components have been installed in the housing 13, the bottom opening is closed, except for a central region, by an electrical cover plate 23 which has a circular opening 25 in its center. Disposed in the housing, in the region closed by the cover plate, are an optional transformer 27 and a high frequency (HF) generator 29 when an induction lamp is used; otherwise a ballast may be installed in its place. An adjustable heat sink 31 that serves to support the lamp assembly in the desired spatial location within the overall lighting system is centrally located on the axial centerline of the housing.

Figure 7:
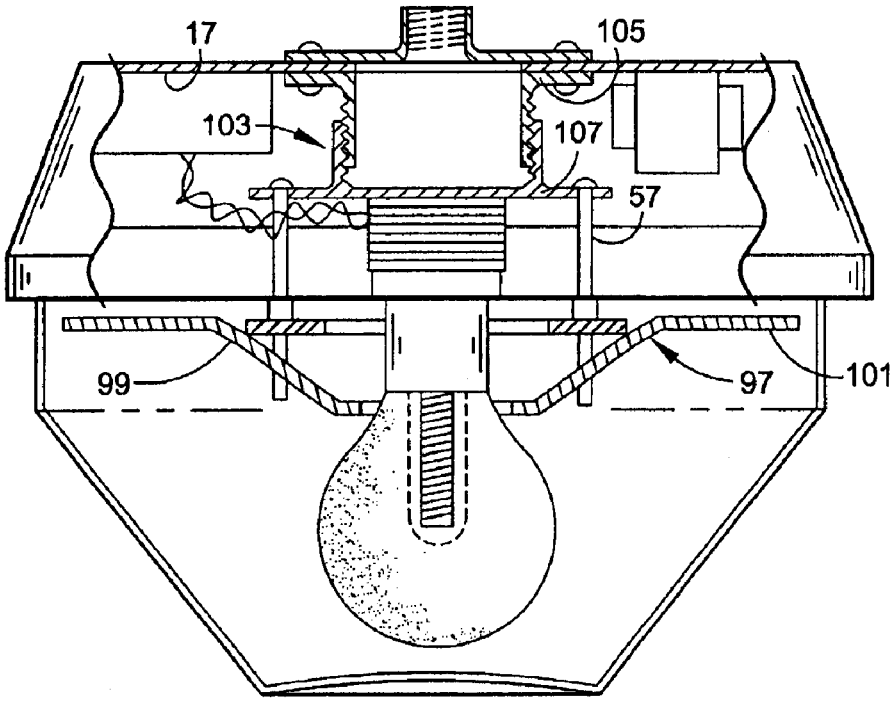
FIG. 7 is a view similar to FIG. 2 showing the reflector of FIGS. 5 and 6 substituted therein, with portions broken away and shown in section to illustrate an alternative embodiment of a support for the lamp base.

The illustrated heat sink 31 includes a central member 33 having two parallel flanges and two flanking L-shaped members 35; it is designed to provide both adjustability and a good thermally conductive path to the housing 13. Other adjustable constructions, such as that depicted in FIG. 7, can alternatively be used; moreover, for certain applications, the heat sink might be constructed without such adjustability. One preferred method of providing infinite adjustability is through pairs of slots 37 in the flat surfaces of the juxtaposed members 33, 35 which are held together in tight thermal contact by pairs of nuts and bolts or the like. Other suitable arrangements could be used, such as a multiple hole pattern in one or both of the abutting flat surfaces. The members 33, 35 are formed from a metal having a thermal conductivity at least equal to that of carbon steel and are of a sufficient thickness to provide a good thermal flow path to conduct heat removal from the lamp base to the housing. The proportioning is such that, when the heat sink 31 is fully extended, if can fit through the central opening 25 in the cover plate 23.

The preferred lamp that is employed in the lighting system is an induction lamp 37; however other lamps such as those referred to as HID lamps, e.g. high pressure sodium and metal halide lamps, as well as compact fluorescent lamps may alternatively be used. Induction lamps are exemplified by the QL series of lamps marketed by Philips Lighting B.V. since 1999. These lamps 37 are illustrated in the drawings throughout this application and include a base section 38 and a bulb section 39. The base 38 has a flat bottom and may be of generally circular shape; it is electronically connected by a cable 41 or the like to the HF generator and carries a circular cross section connector 43 which in turn carries a metal antenna 45. The induction lamp bulb section 39 has a cavity 47 that fits over and accepts the antenna 45 and a bottom cap or fitting 49 that fits over and interconnects with the connector 43. Of course, if a HID or a fluorescent lamp is used, a more conventional socket would be employed as the lamp base and a ballast would be used instead of the HF generator. The QL induction lamp 37 includes a completely sealed glass bulb which is formed to include the central cylindrical cavity 47 of a diameter sufficient to fit over the exterior of the antenna 45 protruding from the base 38. The interior surface of the glass bulb 39 is coated with fluorescent phosphors, and gas/vapor within the bulb includes mercury atoms which, when excited, give off UV radiation that causes the phosphors to emit white light. The cap 49 which surrounds the end of the bulb, where the entrance to the cavity 47 is formed, snaps downward over the circular connector portion 43 of the lamp base 38 and secures the lamp in place, depending from the base in normal operating condition.

Power enters the lighting device through a central hole in the top wall 17 of the housing 13 which is preferably flat. The wiring may enter through a hollow rod or stalk 51 (FIG. 1) when pendant support is used and would lead to any optional transformer 27, and then to the HF generator 29. The HF power from the generator flows through the cable 41 to the antenna 45 which has a ferrite core inside a metal rod, with its exterior being wrapped with an induction coil. In operation, this produces a high frequency magnetic field which excites the gas molecules and causes mercury atoms in the lamp bulb to give off UV radiation which, in turn, excites the phosphors which give off bright white light.

To appropriately efficiently illuminate an area, it is most important to be able to direct the light from the lamp onto the regions where illumination is needed and/or desired. This task is normally accomplished by the use of one or more reflectors located in immediate association with the lamp itself. For purposes of this application, the term reflector is intended to encompass a refractor which, through the use of a prismatic surfaces, likewise has the ability to direct light rays in desired directions.

Very generally, the source of the light may be assumed to be primarily generated at a central point of the bulb lamp, and when an induction lamp 37 is used, it can be assumed (for purposed of focusing) that the major portion of the light is being generated at the center of the spherical bulb portion, with some smaller amount of light radiating outward from the neck portion of the bulb where it transitions into the end cap 49. In the disclosed lighting systems in this application, two reflectors are employed, which are referred to as upper and lower reflectors. The upper reflector is always a true, opaque reflector having a reflecting undersurface which redirects the light being generated without allowing any to pass through, whereas the lower reflector may be either a true reflector or a refractor as described hereinafter. The lower reflector is fixed in its relation to the housing, whereas the upper reflector is always adjustably supported. In addition, the lamp base 38 is desirably adjustably mounted, as through an adjustable heat sink 31 support, so as to vary the center or focal point of the lamp with regard to the fixed lower reflector, in order to achieve the light pattern desired and to accommodate lamps of different size, i.e. wattage. Moreover, the curvature of the upper reflector is selected from various alternatives to achieve a particular lighting pattern desired, and three different such curvatures are illustrated as a part of this application.

The foregoing will be more clearly understood with respect to the description of the preferred embodiments illustrated herein. In the lighting fixture 11 shown in FIGS. 1 though 3, the flat bottom lamp base 38 is supported by tightly affixing it (by screws or other threaded connectors) to the heat sink so that the flat lamp base is in good thermal contact with the horizontal flange 53 of the central member of the heat sink 31, which may have four drilled holes of the same pattern of four threaded holes in the flat bottom of the lamp base 38 to enable tight attachment by four screws. An upper reflector 55 is adjustably supported from a plurality of metal rods 57, e.g. 3, which rods may have enlarged heads that support them in depending relation from the horizontal flange portion 53 of the heat sink extending through three drilled holes; alternatively, they may be press-fit or otherwise secured therein by threads. In FIG. 2, it can be seen that the upper reflector 55 is concave downward, and it is supported through an annular mounting bracket 61 that is affixed to its upper surface. The bracket 61 is affixed to the upper surface of the reflector 55 and has three sleeves 63 which project upwardly. The sleeves 63 are equally spaced at 120° to one another and have bores through which the three metal rods 57 are slidably received. A threaded set screw 65 that resides in a transverse threaded opening in one of the sleeves 63 is tightened against one rod to set the vertical location of the upper reflector 55 relative to the lamp 37 as desired for a particular lighting installation.

A lower reflector 67 is used that is a clear, translucent or prismatic refractor which has an upper rim section 69, an upper cylindrical section 71 that surmounts a lower frustoconical section 73 and a bottom wall 75. The bottom wall 75 can be flat or slightly concave on its exterior surface. The lower reflector 67 is conveniently mounted via four threaded fasteners 76 aligned with four cutouts in the edge of the electrical area closure plate 23, which fasteners are received in threaded openings in the radially inward extending flange of the rim 21 of the housing. More specifically, the lower refractor 67 has its major frustoconical section 73 that tapers inwardly in its exterior dimension at an angle between about 30 and 45 degrees in a downward direction and that is referred to as being downwardly frustoconical. The interior surface of preferably the entire refractor 67, or at least its frustoconical portion 73, is formed of small prismatic surfaces that direct the light horizontally as well as vertically and thereby provide broad coverage of regions surrounding the lighting fixture. As best seen in FIG. 2, the cylindrical section 71 of the lower refractor has a diameter greater than that of the upper reflector 55; it surrounds the upper reflector and provides space to accommodate vertical adjustment of the upper reflector relative to the lower refractor. As previously mentioned with respect to choosing an upper reflector best suited for a particular installation, a convex downward reflector or a combined curvature reflector, such as that illustrated in FIG. 5, or even a flat reflector can alternatively be employed instead of the upper reflector 55 herein illustrated, as a part of the lighting system 11 when it is desired to spread the illumination pattern.

Thus it can be seen, by examination of the overall assembly shown in FIGS. 2 and 3, that the position of the lamp 37 can be adjusted relative to the fixed spatial location of the lower reflector/refractor 67 through the adjustment provided in the heat sink support 31 via the illustrated slotted arrangement. As mentioned, in certain installations, it may be feasible to omit the adjustability in the heat sink. Moreover, adjustment of the upper reflector 55 relative to both the lamp 37 and to the lower reflector/refractor 67 can be accomplished through its raising or lowering, enabled by the use of the bracket 61 and the three metal rods, and then fixed in place by the set screw. This arrangement is particularly useful with an induction lamp, but is also useful with other light emitting lamps, to provide excellent illumination coverage spread uniformly from the lighting system; it particularly provides good uniformity of illumination, even when there is a fairly low overhead clearance, e.g. low ceiling. Where there is fairly wide-apart spacing of such lighting fixtures, one of the two alternatives hereinafter described may be preferred. The illumination pattern provided by a downwardly concave upper reflector may be preferred where the fixtures are spaced fairly close together.

Figure 4:
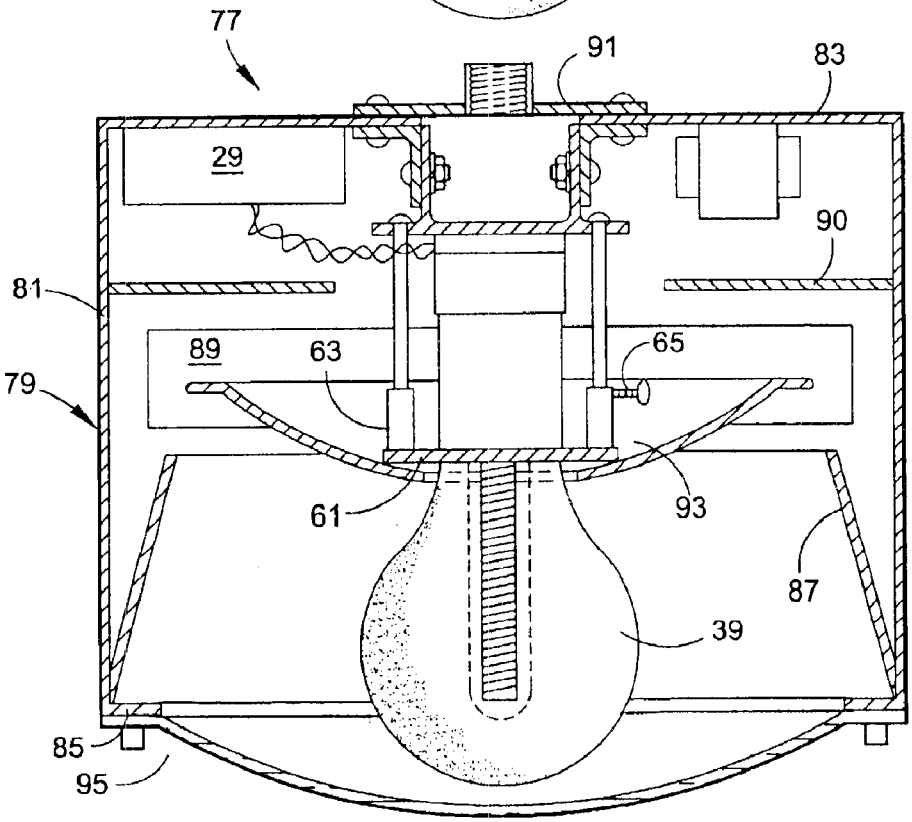
FIG. 4 is a front view, with some elements shown in elevation of an alternative embodiment of a lighting system to that shown in FIGS. 1 through 3, which also embodies various features of the invention.

Illustrated in FIG. 4 is a section view of an alternative cutoff version of a lighting system 77 that utilizes a similar heat sink mounting for an induction lamp 37. Accordingly, items that are common to both lighting systems are identified using the same reference number. This lighting system 77 has a housing 79 which includes an opaque sidewall 81 of true cylindrical shape, and a flat top wall 83 through which there is a central opening for the electrical power connection. It might alternatively be of square or polygonal cross section. A rim 85 at the open bottom of end of the housing 81 is employed to suitably support a lower reflector 87; however other arrangements might be instead employed to support the lower reflector 87, such as by suitable attachment to the sidewall 81. An upper portion of the sidewall 81 is apertured as by having two or more slots or cut outs 89 which are preferably filled by clear or translucent panels to allow light to be directed laterally and upwardly from the system from the region of the neck of the induction lamp 37. A circular mounting bracket 91 is fixed to the upper surface of the top wall 83 of the housing, as by screws, which bracket has a central opening with female threads to accept the threaded end of a pendant 51, such as that shown in FIG. 1. Of course, it could be alternatively mounted flush to a suitable electrical connection box, as well known in this art.

An upper reflector 93 includes a similar annular mounting bracket 61 of that previously described having three sleeves 63 to accommodate three depending metal rods 57, and it is located at the desired relative vertical location through a set screw 65 or the like. However, in this embodiment, the mounting bracket 61 is affixed to the concave upper surface of the reflector, and it is the lower convex undersurface of the reflector 93 that is associated with the bulbous portion 39 of the lamp. The open bottom end of the housing is preferably covered by a clear or translucent lens 95 of glass or plastic that is suitably attached to the bottom rim 85 of the housing; it could be optionally prismatic. Preferably the lens 95 is cup-shaped as shown to allow the bulb 39 to depend slightly below the level of the housing rim 85.

The lower reflector 87, which is fixedly supported by the housing 81, is upperwardly frustoconical. It may be an integral annular reflector of polished metal or the like, as for example, spun aluminum or metalized plastic, or it may be fashioned from a plurality of sections, e.g. two, three, four, eight, etc., in which case, it may have either a circular cross section or the cross section of a regular polygon, which should be understood to be included in the definition of "frustoconical" for purposes of this application. One example of such a segmented reflector is shown in U.S. Pat. No. 6,152,579 to Reed et al. It should be understood that, in this embodiment, the central opening in the reflector 93 that generally surrounds the neck of the induction lamp is sufficiently large to permit it to be adjusted vertically downward to a lowermost location where it is nearly touching the outer surface of the induction lamp bulb 39 when the largest size lamp 37 is being employed and is positioned at the usual focal point with respect to the lower frustoconical reflector 87. It can be seen that this arrangement provides a desired wide spreading pattern where more light is directed radially outward to the reach regions at slightly greater distances from the housing as a result of the concave downward shape of the adjustable upper reflector 55. Thus, is may be preferred for more widely spaced-apart fixtures.

Figure 5:
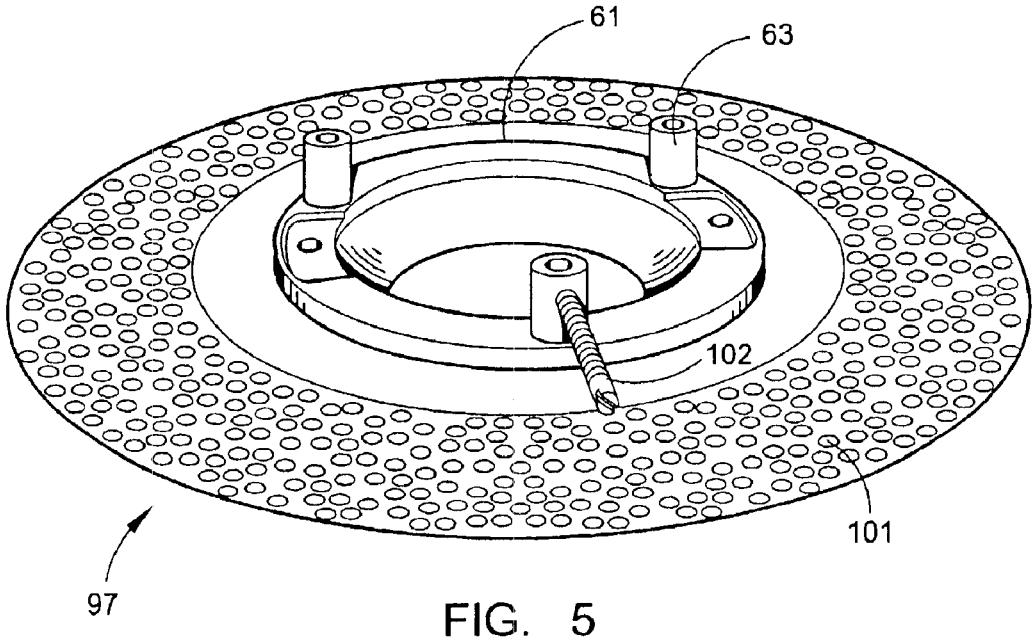
FIG. 5 is a top perspective view of a third type of an adjustable upper reflector that may be substituted for either of the adjustable upper reflectors illustrated in the lighting systems of FIGS. 1 through 4.
Figure 6:
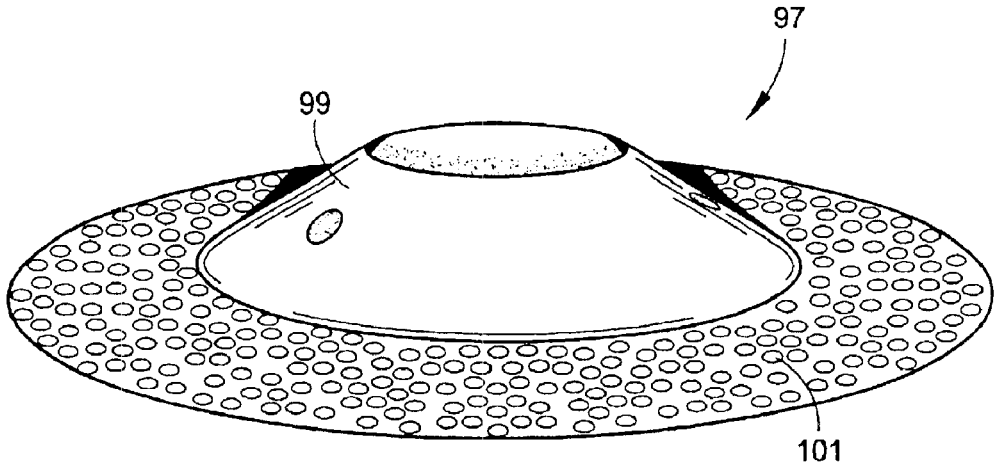
FIG. 6 is a bottom perspective view of the reflector of FIG. 5.

Illustrated in FIGS. 5 and 6 is another alternative upper reflector 97 which is referred to as a combined curvature reflector because it has two contiguous sections of different curvature. More specifically, there is a central frustoconical section 99, which is downwardly frustoconical; it is depicted preferably having a smoothly polished surface which is a true section of a cone. However, the surface could be slightly convex outward (which should be understood to be included in the definition of "frustoconical") or may have a pebbled or faceted surface to better spread the light. Contiguous with the outer circular edge of the inner section 99, there is a substantially flat, annular outer section 101 which has a highly reflective, pebbled, faceted or hammered surface. By pebbled is meant as having a plurality of shallow spheroidal surface indentations which substantial uniformly cover the entire surface. Aside from its surface texture, the outer section is preferably essentially flat and is oriented horizontal, perpendicular to the centerline or axis of the housing 13, as can be seen in the FIG. 7; however, it might also be formed with a shallow, concave downward shape. Alternatively, for certain lighting applications, the entire reflector 97 might be provided with a polished surface or a hammered or faceted surface, and it may also be substantially flat instead of curved. There are three regularly spaced openings in the inner frustoconical section 99 to allow passage therethrough of the three metal rods 15, and a similar supporting bracket 61 to that previously described is affixed to the upper surface of the frustoconical section 99, and one of the sleeves 63 of which has a threaded opening to accept an elongated screw 102 that is used to determine the desired vertical placement of the upper reflector 97 relative to the housing itself and to the lamp base 38 for supporting the induction lamp 37. An alternative heat sink 103 is used to support the lamp base 38. It has an upper section 105 and a lower section 107 which are provided with interengaging threads on vertical hollow posts that are affixed to base flanges. The base flange of the upper section 105 is affixed by screws or the like to the top wall 17 of the housing, and the base flange of the lower section 107 is attached by screws received in the lamp base 38. The male threads on the exterior of the upper section post will mate with female threads on the inner surface of the lower section 107 which allows essentially infinite adjustment within the range desired. A set screw (not shown) maintains the desired vertical level at which the lamp base will be supported.

It has been found that this particular construction of the adjustable upper reflector 97 having this combined curvature, in combination with an induction lamp 37, when employed with either the fixture illustrated in FIGS. 1–3 or the fixture illustrated in FIG. 4, provides a particularly improved lighting pattern from the standpoint of assuring excellent uniformity of illumination even when fixtures are widely spread apart. Thus, it should be understood that this novel reflector might likewise be advantageously substituted for the reflector 93 of FIG. 4; moreover it should be understood that this novel upper reflector also provides excellent lighting distribution when used in combination with other lamps, e.g. an HID lamp.

Although the present invention has been described in terms of certain preferred embodiments and exemplified with respect thereto, one having ordinary skill in this art will readily appreciate the various modifications, changes, substitutions, and even omissions may be made without departing from the spirit and scope thereof, which is defined by the claims appended hereto. For example, the housing may have a different regular cross section instead of being circular, e.g. square or polygonal. The disclosures of all U.S. patents cited herein are expressly incorporated herein by reference.

Particular features of the invention are emphasized in the claims which follow.

What is claimed is:

1. An adjustable lighting system comprising:

a housing having a flat upper wall, a sidewall and an open bottom, a lamp base for holding an induction lamp in depending relationship thereto, which lamp base is mounted within said housing above said open bottom, a metallic beat sink support affixed to said housing and to said lamp base to support an induction lamp on about a centerline of said housing, an upper reflector having a central opening to accommodate the neck of a lamp, means mounting said upper reflector in depending relationship from said housing or from said heat sink so as to be adjustable in a direction axial to a lamp held by said base, an induction lamp generator mounted within said housing and electrically connected to said lamp base, and a lower reflector proportioned to surround said upper reflector and a lamp held by said base, which lower reflector is mounted within said open bottom of said housing and extends below said lamp and said upper reflector, wherein said generator is mounted on the undersurface of said flat upper wall and in thermal contact therwith, and wherein said upper reflector mounting means includes a plurality of rods depending from said metallic heat sink support.

2. An adjustable lighting system comprising:

a housing having a sidewall and an open bottom, a lamp base for holding a lamp in depending relationship thereto, a support affixed to said housing and to said lamp base to support said lamp on about a centerline of said housing, a reflector having a central opening to accommodate the neck of a lamp, and means mounting said reflector in depending relationship from said housing or from said support so as to be adjustable in a direction axial to a lamp held by said base, said reflector having a downwardly frustoconical center section and a contiguous annular, generally flat outer section.

3. The lighting system according to claim 2 wherein said outer section has a pebbled reflecting undersurface.

4. The lighting system according to claim 2 wherein said lamp is an induction lamp, said support is a metal heat sink, and an induction lamp generator mounted within said housing and electrically connected to said lamp base.

5. An adjustable lighting system comprising:

a housing having an outer sidewall and an open bottom, a lamp base, support means connected to said housing and to said lamp base to position said lamp base on about the centerline of said generally cylindrical housing, an upper reflector having a downwardly frustoconical inner section, an essentially flat annular outer section and a central opening to accommodate the neck of a lamp, means mounting said upper reflector in depending relationship from said lamp base so as to be adjustable in a direction axial to a lamp connected to said base, and a generally frustoconical lower reflector which surrounds a lamp connected to said base and which extends below said upper reflector, which lower reflector is mounted within said open bottom of said housing, said support means being adjustable in an axial direction to permit varying the positioning of said lamp base relative to said housing and to said lower reflector while said upper reflector is adjustable with respect to said lamp base.

6. An adjustable lighting system comprising:

a housing having a sidewall and an open bottom, a lamp base for holding an induction lamp in depending relationship thereto, which lamp base is mounted within said housing above said open bottom, a metallic heat sink support affixed to said housing and to said lamp base to support an induction lamp on about a centerline of said housing, an upper reflector having a central opening to accommodate the neck of a lamp, means mounting said upper reflector in depending relationship from said housing or from said heat sink so as to be adjustable in a direction axial to a lamp held by said base, an induction lamp generator mounted within said housing and electrically connected to said lamp base, and a lower reflector proportioned to surround said upper reflector and a lamp held by said base, which lower reflector is mounted within said open bottom of said housing and extends below said lamp and said upper reflector, wherein said heat sink is axially adjustable so as to allow said lamp base to be positioned at different locations relative to said housing and to said lower reflector.

7. An adjustable lighting system comprising:

a housing having a sidewall and an open bottom, a lamp base for holding an induction lamp in depending relationship thereto, which lamp base is mounted within said housing above said open bottom, a metallic heat sink support affixed to said housing and to said lamp base to support an induction lamp on about a centerline of said housing, an upper reflector having a downwardly frustoconical inner section, an essentially flat annular outer section and a central opening to accommodate the neck of a lamp, means mounting said upper reflector in depending relationship from said housing or from said heat sink so as to be adjustable in a direction axial to a lamp held by said base, an induction lamp generator mounted within said housing and electrically connected to said lamp base, and a lower reflector proportioned to surround said upper reflector and a lamp held by said base, which lower reflector is mounted within said open bottom of said housing and extends below said lamp and said upper reflector.

8. An adjustable lighting system comprising:

a housing having an outer sidewall and an open bottom, a lamp base adapted to receive an induction lamp, an induction lamp generator supported within said housing, support means connected to said housing and to said lamp base to position said lamp base on about the centerline of said generally cylindrical housing, said lamp base support comprising three metal pieces which have flat surfaces that are slidably juxtaposed and that have areas of surface to surface contact to provide both adjustable mounting of said lamp base and a heat flow path, an upper reflector having a central opening to accommodate the neck of a lamp, means mounting said upper reflector in depending relationship from said lamp base so as to be adjustable in a direction axial to a lamp connected to said base, and a generally frustoconical lower reflector which surrounds a lamp connected to said base and which extends below said upper reflector, which lower reflector is mounted within said open bottom of said housing, said support means being adjustable in an axial direction to permit varying the positioning of said lamp base relative to said housing and to said lower reflector while said upper reflector is adjustable with respect to said lamp base.

* * * * *